US011564032B2

(12) United States Patent
Garcia et al.

(10) Patent No.: US 11,564,032 B2
(45) Date of Patent: Jan. 24, 2023

(54) SPEAKER SYSTEM WITH ASYMMETRICAL COVERAGE HORN

(71) Applicant: Harman International Industries, Incorporated, Stamford, CT (US)

(72) Inventors: Christian Manuel Garcia, Winnetka, CA (US); An Duc Nguyen, Simi Valley, CA (US); James Garrett, Simi Valley, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 17/246,216

(22) Filed: Apr. 30, 2021

(65) Prior Publication Data

US 2022/0353607 A1 Nov. 3, 2022

(51) Int. Cl.

| | |
|---|---|
| ***H04R 1/34*** | (2006.01) |
| ***H04R 1/02*** | (2006.01) |
| ***H04R 1/26*** | (2006.01) |
| ***H04R 1/30*** | (2006.01) |

(52) U.S. Cl.

CPC ..... *H04R 1/345* (2013.01); *H04R 1/025* (2013.01); *H04R 1/26* (2013.01); *H04R 1/30* (2013.01); *H04R 2400/11* (2013.01)

(58) Field of Classification Search

CPC ..... H04R 1/345; H04R 1/025; H04R 1/26; H04R 1/30; H04R 2400/11

See application file for complete search history.

(56) References Cited

U.S. PATENT DOCUMENTS

| | | | | |
|---|---|---|---|---|
| 4,580,655 | A * | 4/1986 | Keele, Jr. | G10K 11/025 181/187 |
| 7,275,621 | B1 * | 10/2007 | Delgado, Jr. | H04R 1/403 181/150 |
| 7,590,257 | B1 * | 9/2009 | Blanchard | H04R 1/345 381/342 |
| D796,472 | S | 9/2017 | Sprinkle | |
| 9,924,249 | B2 * | 3/2018 | Sprinkle | H04R 1/345 |
| 10,848,862 | B2 * | 11/2020 | Showalter | H04R 1/30 |
| 2017/0055067 | A1 * | 2/2017 | Moro | H04R 1/02 |

FOREIGN PATENT DOCUMENTS

| | | | | |
|---|---|---|---|---|
| TW | 200806069 | A * | 1/2008 | H04R 5/04 |

* cited by examiner

*Primary Examiner* — Oyesola C Ojo
(74) *Attorney, Agent, or Firm* — Brooks Kushman P.C.

(57) ABSTRACT

A speaker system is provided with a housing adapted to mount to a support. A driver is supported by the housing and arranged to project sound about a first axis extending at an offset angle relative to a longitudinal axis extending from the housing. A waveguide extends from the driver to define a cavity extending along the first axis. The waveguide includes a first segment formed at a first angle relative to the longitudinal axis, and a second segment formed at a second angle relative to the longitudinal axis, wherein the second segment is arranged opposite the first segment and the second angle is greater than the first angle to collectively provide an asymmetrical sound pattern in a first plane.

20 Claims, 7 Drawing Sheets

SPEAKER SYSTEM WITH ASYMMETRICAL COVERAGE HORN

TECHNICAL FIELD

One or more embodiments relate to a speaker system with a horn that provides asymmetrical sound coverage.

BACKGROUND

A loudspeaker typically includes one or more drivers that are each coupled to a horn. The horn includes an input throat and an output mouth. The throat is sized to match the acoustic impedance and exit diameter of the driver and to reduce distortion of the acoustic signal. The mouth is typically large enough to project sound efficiently at a desired frequency. The horn guides the acoustic signal or acoustic energy into particular directions or regions. The horn includes a waveguide that extends between the throat and the mouth to constrain and control the radiation of acoustic energy. The surfaces of the waveguide produce a coverage pattern of a specified total coverage angle that may differ horizontally and vertically. The coverage angle is a total angle in any plane of observation (although typically horizontal and vertical orthogonal planes are used) about a reference axis that extends normal to the face of the loudspeaker. The coverage angle is evaluated as a function of frequency and corresponds to the angle at which the intensity of sound, or sound pressure level (SPL), is half of the SPL on the axis.

Audio systems may include a plurality of loudspeakers to provide sound from multiple locations in a horizontal plane (e.g., "surround" sound). Audio systems may also include loudspeakers to provide sound within a vertical plane, including floor or wall mounted loudspeakers in combination with loudspeakers mounted to the ceiling. Loudspeakers that are mounted to a surface, e.g., the floor, wall, or ceiling, may be rotated to adjust the coverage pattern toward a target listening area. However, speakers that are mounted within a wall may be difficult to rotate due to the narrow depth of the wall.

SUMMARY

In one or more embodiments, a speaker system is provided with a housing adapted to mount to a support. A driver is supported by the housing and arranged to project sound about a first axis extending at an offset angle relative to a longitudinal axis extending from the housing. A waveguide extends from the driver to define a cavity extending along the first axis. The waveguide includes a first segment formed at a first angle relative to the longitudinal axis, and a second segment formed at a second angle relative to the longitudinal axis, wherein the second segment is arranged opposite the first segment and the second angle is greater than the first angle to collectively provide an asymmetrical sound pattern in a first plane.

In one or more embodiments, a housing is provided with a faceplate adapted to mount to a wall or a ceiling, and a frame extending from the faceplate to be received in the wall or the ceiling. A horn includes a throat, a mouth, and a waveguide that extends between the throat and the mouth. The throat is disposed adjacent to a first driver to receive projected sound, and is arranged about a first axis extending from the first driver at an offset angle relative to a longitudinal axis extending normal to the faceplate. The mouth is coupled to the faceplate. The waveguide extends from the throat to the mouth to define a cavity extending along the first axis. The waveguide comprises: a first segment formed at a first angle relative to the longitudinal axis, and a second segment formed at a second angle relative to the longitudinal axis. The second segment is arranged opposite the first segment and the second angle is greater than the first angle to collectively provide an asymmetrical sound pattern in a first plane.

In one or more embodiments, a speaker system is provided with a housing with a faceplate and a frame extending from the faceplate. A first driver is supported by the frame and is arranged to project sound about a first axis extending at an offset angle relative to a longitudinal axis extending normal to the faceplate. A horn includes a throat disposed adjacent to the first driver to receive projected sound, and a mouth coupled to the faceplate. A waveguide extends from the throat to the mouth to define a cavity extending along the first axis. The waveguide comprises: a first segment formed at a first angle relative to the longitudinal axis, and a second segment formed at a second angle relative to the longitudinal axis. The second segment is arranged opposite the first segment and the second angle is greater than the first angle to collectively provide an asymmetrical sound pattern in a first plane.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
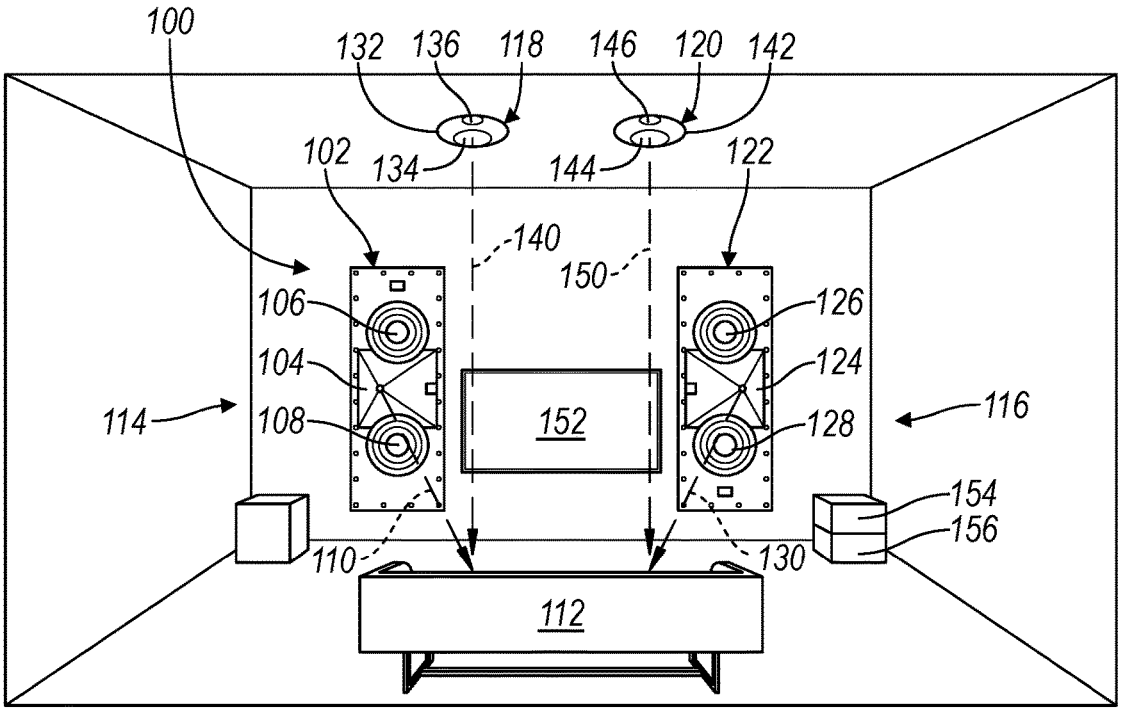
FIG. 1 is a front perspective view of a home entertainment system including speaker systems with horns that provide asymmetrical sound coverage patterns within a listening environment.

With reference to FIG. 1, a speaker system that provides an asymmetrical sound pattern is illustrated in accordance with one or more embodiments and represented by numeral 100. The speaker system 100 includes a housing 102 that supports three loudspeakers: a first loudspeaker 104, a second loudspeaker 106, and a third loudspeaker 108. The housing 102 may be arranged in a flush mount "in-wall" configuration at a front-left position, as illustrated in FIG. 1. The first loudspeaker 104 is mounted to a central portion of the housing 102 and projects sound about an axis 110 that is offset from a longitudinal axis that extends normal to a front surface of the first loudspeaker 104 to provide an asymmetrical sound pattern in a horizontal plane toward a target listening area 112. The second loudspeaker 106 and the third loudspeaker 108 are mounted above and below the first loudspeaker 104, respectively, and project sound axially to provide symmetric sound patterns.

The speaker system 100 may be combined with other audio, visual, and peripheral devices to provide a home entertainment system 114. In one or more embodiments, the audio devices include a front-right speaker system 116, a top-left speaker system 118, and a top-right speaker system 120 to collectively provide sound to the target listening area 112. In one or more embodiments, the home entertainment system 114 also includes side speakers and rear speakers (not shown) to collectively provide 360 degree "surround" sound.

The front-right speaker system 116 includes similar components as the front-left speaker system 100, including a housing 122 that supports a first loudspeaker 124, a second loudspeaker 126, and a third loudspeaker 128. The housing 122 may be arranged in a flush mount "in-wall" configuration at a front-right position, as illustrated in FIG. 1. The first loudspeaker 124 is mounted to a central portion of the housing 122 to project sound about an axis 130 that is offset from a longitudinal axis that extends normal to a front surface of the first loudspeaker 124 to provide an asymmetrical sound pattern in a horizontal plane toward the target listening area 112. The second loudspeaker 126 and the third loudspeaker 128 are mounted above and below the first loudspeaker 124, respectively. The second loudspeaker 126 and the third loudspeaker 128 project sound axially in symmetric sound patterns.

The first loudspeaker 124 of the front-right speaker system 116 and the first loudspeaker 104 of the front-left speaker system 100 may be arranged such that they are generally mirror images of each other about a vertical axis to both provide asymmetric sound inward in the horizontal plane toward the target listening area 112, e.g., toward a couch located at the center of the room, as shown in FIG. 1.

Figure 2:
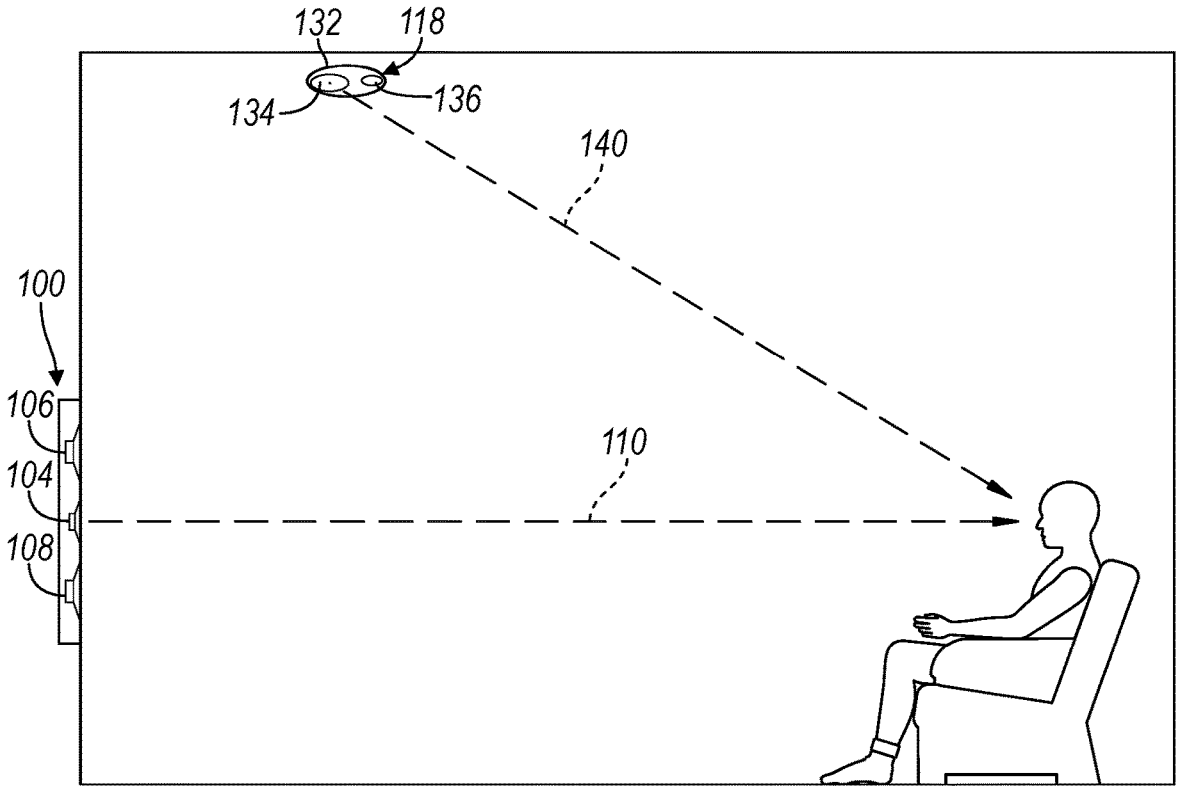
FIG. 2 is a side view of the home entertainment system of FIG. 1, illustrating a front speaker system and a top speaker system.

Referring to FIGS. 1 and 2, the top-left speaker system 118 and the top-right speaker system 120 may also provide asymmetrical sound patterns toward the target listening area 112. The top-left speaker system 118 includes a housing 132 that supports a first loudspeaker 134 and a second loudspeaker 136. The housing 132 may be arranged in a flush mount "in-ceiling" configuration at a top-left position, as illustrated in FIG. 1. The first loudspeaker 134 is mounted in a forward portion of the housing 132 and projects sound about an axis 140 that is offset from a vertical axis that extends normal to a front surface of the first loudspeaker 134 to provide an asymmetrical sound pattern in a vertical plane toward the target listening area 112, as shown in FIG. 2. The second loudspeaker 136 is mounted rearward of the first loudspeaker 134.

The top-right speaker system 120 includes a housing 142 that supports a first loudspeaker 144 and a second loudspeaker 146. The housing 142 may be arranged in a flush mount "in-ceiling" configuration at a top-right position, as illustrated in FIG. 1. The first loudspeaker 144 is mounted in a forward portion of the housing 142 and projects sound about an axis 150 that is offset from a vertical axis that extends normal to a front surface of the first loudspeaker 144 to provide an asymmetrical sound pattern in a vertical plane toward the target listening area 112. The second loudspeaker 146 is mounted rearward of the first loudspeaker 144.

Each speaker system 100, 116, 118, 120 may include high-frequency loudspeakers and low-frequency loudspeakers. High-frequency sound patterns are generally more narrow than low-frequency sound patterns. Accordingly, in one or more embodiments the high-frequency loudspeakers of each speaker system 100, 116, 118, 120 are arranged off-axis to direct their respective asymmetrical sound patterns toward a target listening area. Whereas the low-frequency loudspeakers direct symmetrical sound patterns toward the target listening area while projecting sound about a longitudinal axis.

The home entertainment system 114 may also include a television 152 and an audio source 154 such as a DVD player, a video game console, an audio receiver, or a router. The home entertainment system 114 also includes a home controller 156 for controlling various aspects of the devices included in the home entertainment system 114. For example, the home controller 156 may separate audio from the audio source 154 into multiple channels corresponding to different locations in the room, e.g., front-center, front-left, front-right, rear-left, rear-right, top-left, top-right, etc. The home controller 156 may include crossover functionality and separate the audio into different channels based on frequency, e.g., high, medium, low, etc. The home controller 156 may provide audio channels to the appropriate speaker. For example, the home controller 156 may provide: the front-left audio channels to the front-left speaker system 100, the front-right audio channels to the front-right speaker system 116, the top-left audio channels to the top-left speaker system 118, and the top-right audio channels to the top-right speaker system 120. In other embodiments, the home controller 156 provides all audio channels to each speaker system, and the speaker system selects the appropriate channels based on its location.

As described above, the home controller 156 may separate the audio into multiple channels, including top channels. Such top channels may be used to simulate stationary or moving overhead sound, e.g., a plane flying overhead. Existing home entertainment systems may include wall and/or ceiling mounted speakers (not shown) that are adjustable to manually adjust the coverage pattern towards a target listening area and away from objects in the room, e.g., walls. Such adjustment may be limited for speaker systems that are mounted within a wall or ceiling due to the relatively narrow depth of the wall. Accordingly, each speaker system 100, 116, 118, 120 may include an off-axis loudspeaker horn to provide an asymmetrical sound pattern.

Figure 3:
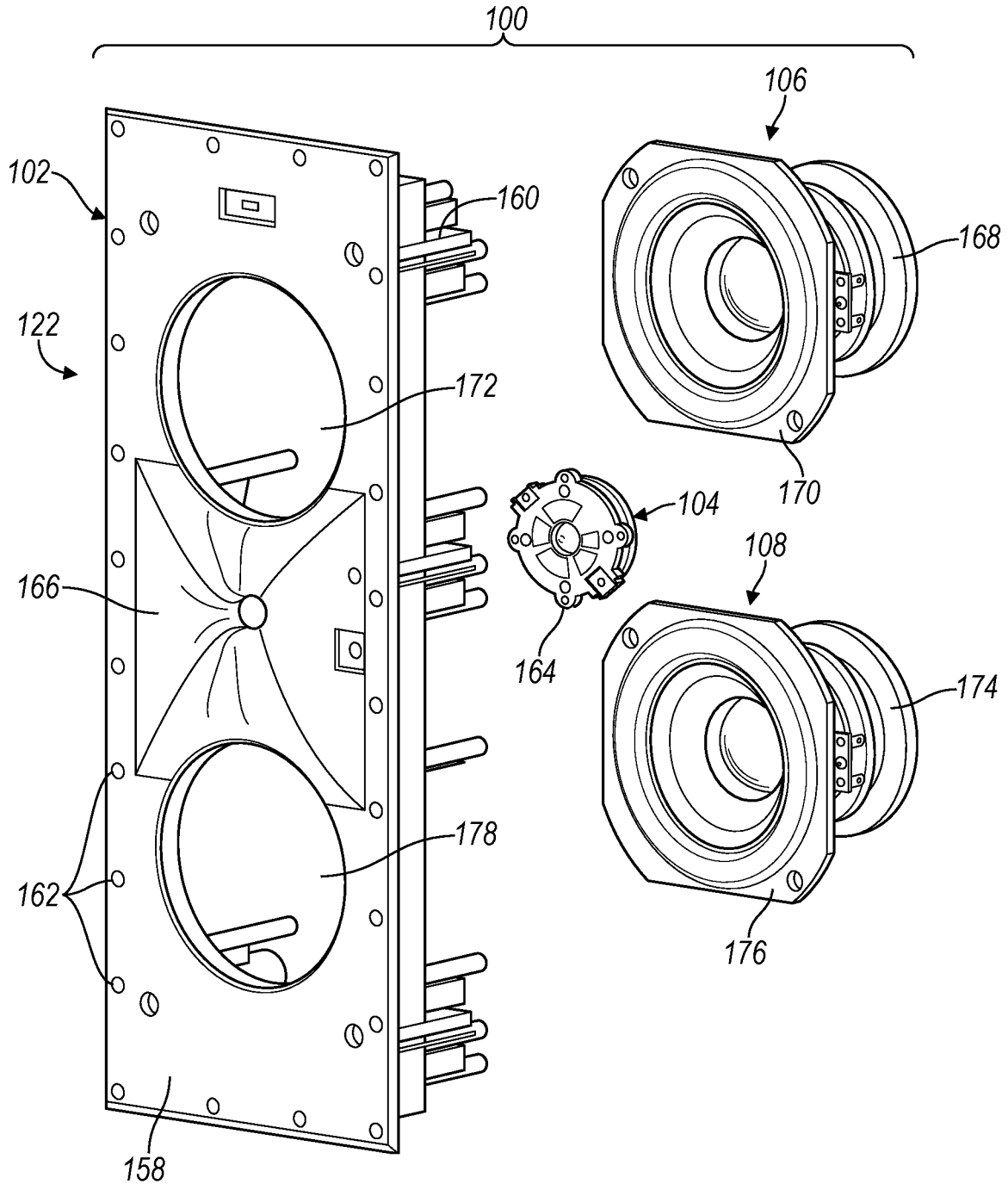
FIG. 3 is an exploded view of a front-left speaker system of FIG. 1.

With reference to FIG. 3, the housing 102 provides for mounting the speaker system 100 in an in-wall configuration. The housing 102 of the front-left speaker system includes a faceplate 158 and a frame 160. The faceplate 158 is formed in a generally planar shape with a series of apertures 162 formed around an outer periphery to receive fasteners (not shown) to mount to a support, e.g., a wall. The frame 160 extends from the faceplate 158 to extend through the wall (shown in FIG. 5) to provide an in-wall speaker system configuration. The housing 102, including the faceplate 158 and the frame 160, may be integrally formed as a single component, which reduces weight and simplifies assembly. The frame 160 supports the first loudspeaker 104, the second loudspeaker 106, and the third loudspeaker 108.

The first loudspeaker 104 includes a first driver 164 and a horn 166. The first driver 164 receives an audio signal from the audio source 154 and/or home controller 156 and projects sound. The first driver 164 may be a compact high-frequency compression driver or tweeter that projects sound between 2 kHz and 20 kHz. The horn 166 guides the sound projected by the first driver 164 to form an asymmetric pattern. The horn 166 may be integrated into the housing 102 or attached to the housing 102.

The second loudspeaker 106 includes a second driver 168 and a diaphragm 170. The second driver 168 may be a compact low-frequency compression driver or woofer that projects sound between 50 Hz and 1 kHz. The diaphragm 170 attaches to the second driver 168 and to the housing 122 about an opening 172 formed through the faceplate 158. The third loudspeaker 108 includes a third driver 174 and a diaphragm 176. The third driver 174 may be a compact low-frequency compression driver or woofer that projects sound between 50 Hz and 1 kHz. The diaphragm 176 attaches to the third driver 174 and to the housing 122 about an opening 178 formed through the faceplate 158.

Figure 4:
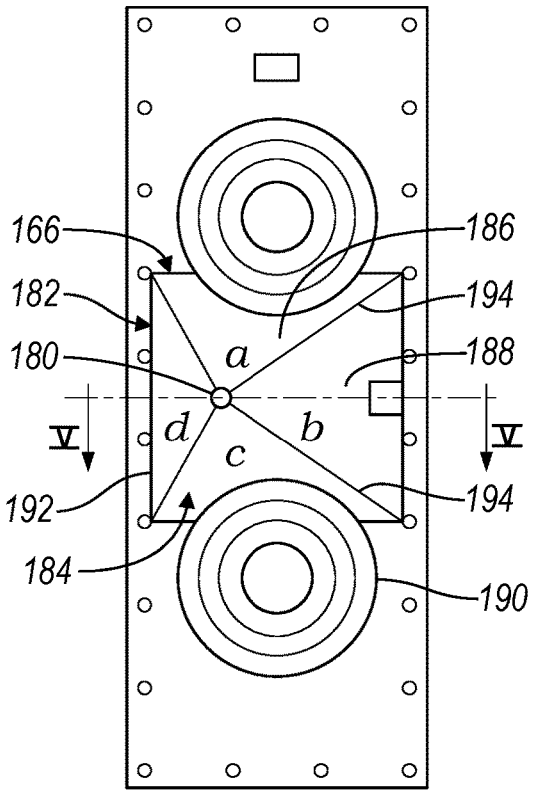
FIG. 4 is a front view of the front-left speaker system of FIG. 3.
Figure 5:
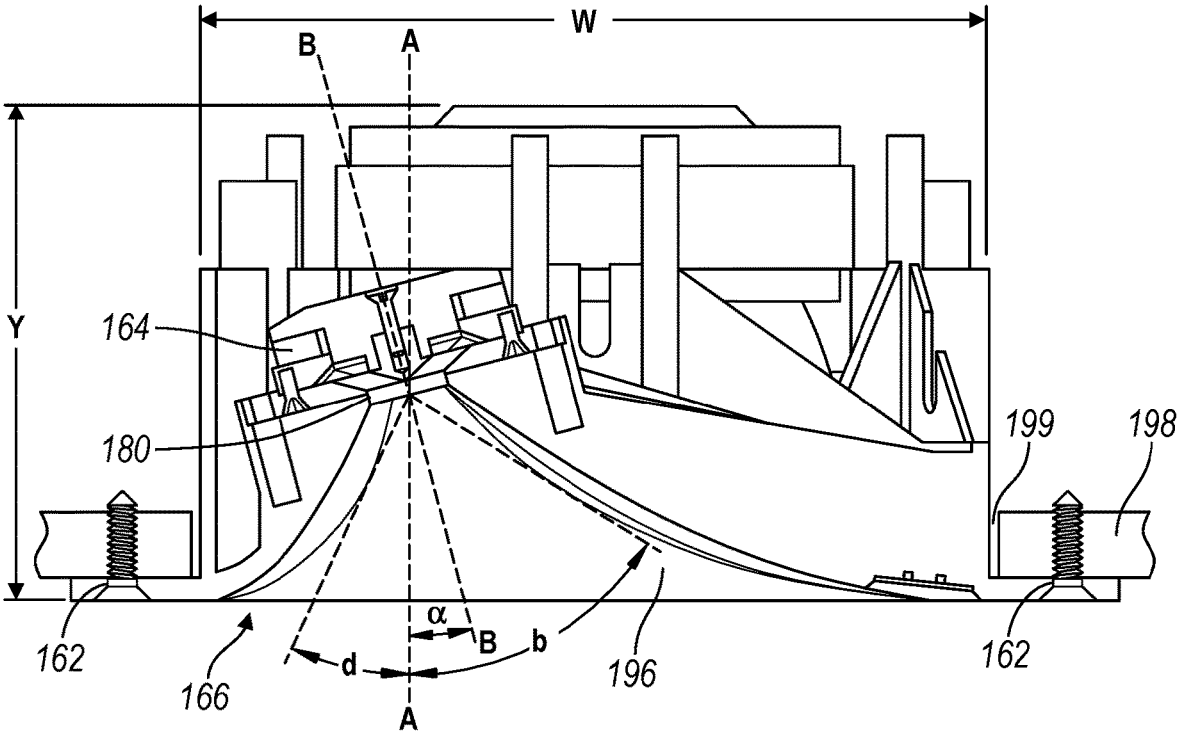
FIG. 5 is an enlarged section view of the front-left speaker system of FIG. 4, taken along section line V-V.

Referring to FIGS. 4 and 5, the shape of the horn 166 provides an asymmetrical sound coverage pattern. The horn 166 includes a throat 180 and a mouth 182. The throat 180 is disposed adjacent to the first driver 164 to receive projected sound. The mouth 182 is arranged adjacent to the faceplate 158. The horn 166 also includes a waveguide 184 that extends from the throat 180 to the mouth 182. The waveguide 184 includes four segments: a first segment 186, a second segment 188, a third segment 190, and a fourth segment 192. The four segments are angularly spaced apart from each other about a longitudinal Axis A that extends through the throat 180 and normal to the faceplate 158. Adjacent segments are coupled to each other by joints 194 that extend between the throat 180 and the mouth 182. The waveguide 184 may also be formed as a single unitary structure with the joints 194 extending between adjacent segments.

With reference to FIG. 5, the first driver 164 is mounted to the frame 160 at an acute angle relative to the faceplate 158 to project sound about an Axis B that extends at an offset angle relative to Axis A. The waveguide 184 is formed in a generally frusto-pyramidal shape and defines a cavity 196 that extends along Axis B. The four segments 186, 188, 190, 192 flare outward from the throat 180 to the mouth 182. For example, the cross-sectional area of the waveguide 184 may expand exponentially. In other examples, the cross-sectional area of the waveguide 184 may remain substantially constant, contract, or any combination thereof. The shape of the first segment 186 provides a coverage angle (a) in a vertical plane relative to Axis A (not shown). The shape of the second segment 188 provides a coverage angle (b) in a horizontal plane relative to Axis A. The shape of the third segment 190 provides a coverage angle (c) in a vertical plane relative to Axis A (not shown). The shape of the fourth segment 192 provides a coverage angle (d) in a horizontal plane relative to Axis A. The coverage angle is evaluated as a function of frequency and corresponds to the angle at which the intensity of sound, or sound pressure level (SPL), is half of the SPL on Axis A.

The second segment 188 and the fourth segment 192 are formed in different shapes to provide different coverage angles (b) and (d). Coverage angle (b) may be between 0-80 degrees and coverage angle (d) may be between 0-60 degrees. In one or more embodiments, the second segment 188 provides a coverage angle of 80 degrees; and the fourth segment 192 provides a coverage angle of 40 degrees. The first segment 186 and the third segment 190 may be formed in the same shape to provide the same coverage angle. Coverage angles (a) and (c) may be between 0-90 degrees. In one or more embodiments, angle (a) and angle (c) are both 90 degrees.

The speaker system 100 may be mounted within a wall 198. The apertures 162 of the faceplate 158 receive fasteners to mount the housing 102 to the wall 198. The frame 160 extends from the faceplate 158 to extend through an opening 199 in the wall 198. The speaker system 100 has a compact design, e.g., with a depth (Y) that is less than 101.6 mm (4.0 inches), so that it fits within a standard wall 198. The speaker system 100 also has a width (w) that is less than 406.4 mm (16.0 inches) so that if fits between adjacent studs in the wall 198.

Figure 6:
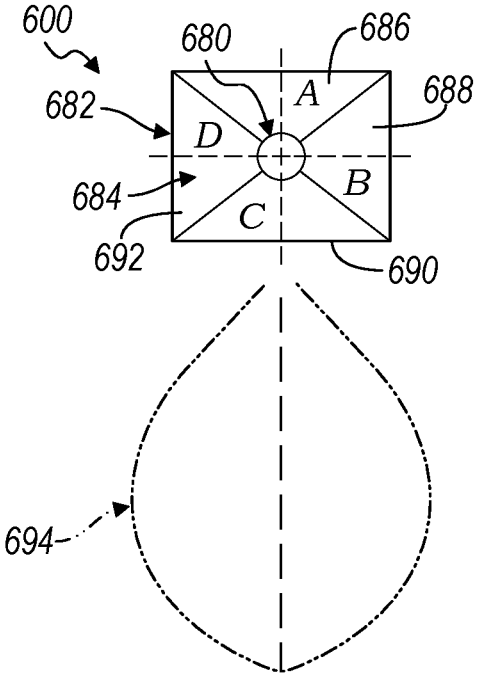
FIG. 6 is a schematic diagram of a symmetrical horn to project sound in a symmetrical coverage pattern.
Figure 7:
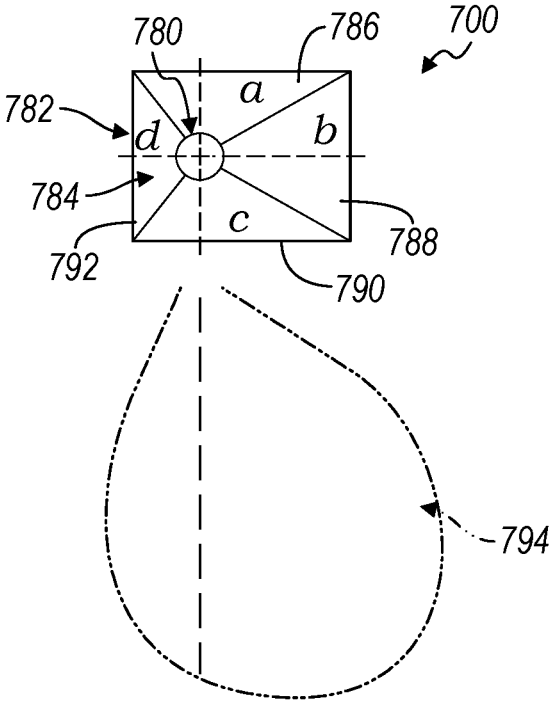
FIG. 7 is a schematic diagram of an asymmetrical horn to project sound in an asymmetrical coverage pattern.

FIGS. 6 and 7 illustrate a comparison of a symmetrical horn 600 to an asymmetrical horn 700. The symmetrical horn 600 includes a throat 680, a mouth 682, and a waveguide 684 including four segments 686, 688, 690, and 692 extending between the throat 680 and mouth 682. The throat 680 is centered within the symmetrical horn 600. The first segment 686 and the third segment 690 may be formed in the same shape to provide the same coverage angle. Coverage angles (A) and (C) may be between 0-90 degrees. In one or more embodiments, angle (A) and angle (C) are both 90 degrees to provide a symmetrical coverage pattern in a vertical plane (not shown). The second segment 688 and the fourth segment 692 may also be formed in the same shape to provide the same coverage angle. Coverage angles (B) and (D) may be between 0-90 degrees. In one or more embodiments, angle (B) and angle (D) are both 80 degrees to provide a symmetrical coverage pattern 694 in a horizontal plane.

The asymmetrical horn 700 includes a throat 780, a mouth 782, and a waveguide 784 including four segments 786, 788, 790, and 792 extending between the throat 780 and mouth 782. The throat 780 is offset horizontally within the asymmetrical horn 700, such that the second segment 788 and the third segment 790 are formed in different shapes to provide different coverage angles (b) and (d). Coverage angle (b) may be between 0-80 degrees and coverage angle (d) may be between 0-60 degrees. In one or more embodiments, the second segment 188 provides a coverage angle (b) of 80 degrees; and the fourth segment 192 provides a coverage angle (d) of 60 degrees to collectively provide an asymmetrical coverage pattern 794 in a horizontal plane. The throat 780 is centered vertically within the asymmetrical horn 700, such that the first segment 786 and the third segment 790 are formed in similar shapes and generally mirror images of each other to provide a symmetrical coverage pattern in a vertical plane (not shown).

Figure 8:
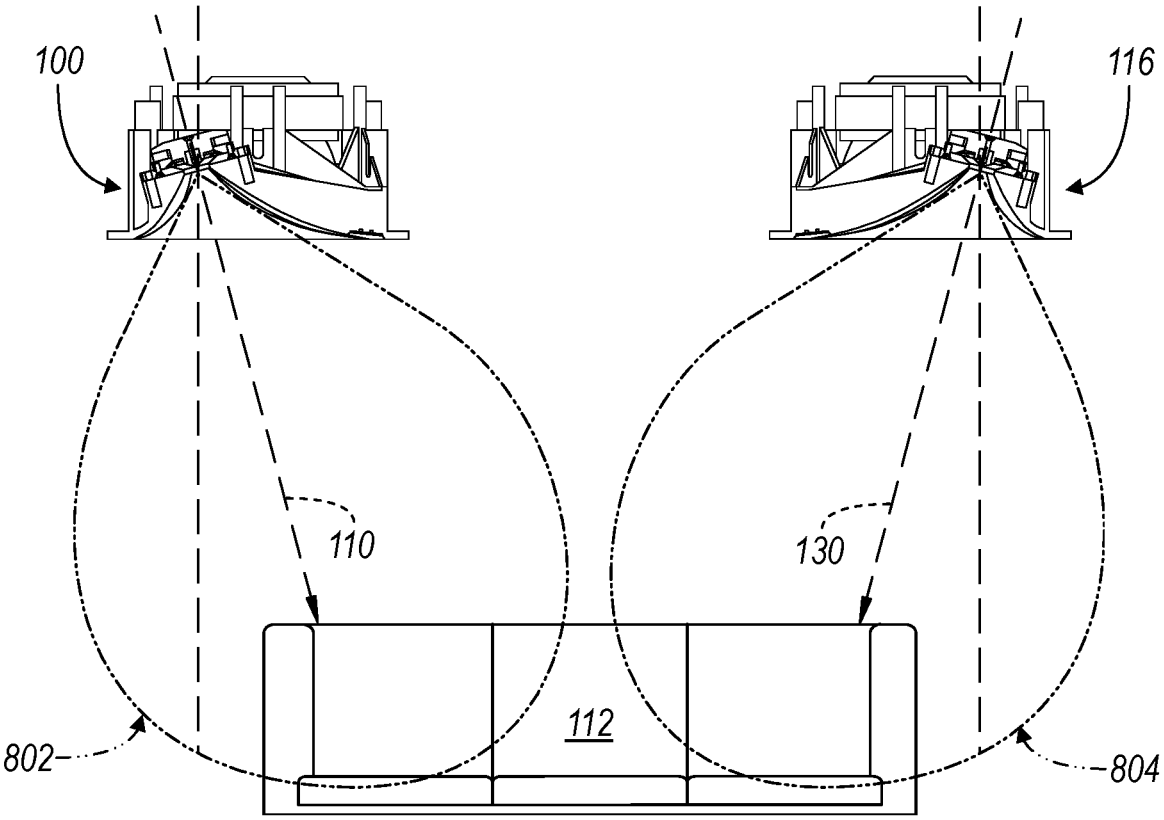
FIG. 8 is top schematic view of the home entertainment system of FIG. 1, illustrating the front-left speaker system and the front-right speaker system projecting sound in asymmetrical coverage patterns within the listening environment.

With reference to FIG. 8, the front-left speaker system 100 and the front-right speaker system 116 both provide asymmetrical coverage patterns 802, 804, respectively, in a horizontal plane to project sound toward the target listening area 112. In one or more embodiments, the front-right speaker system 116 is identical to the front-left speaker system 100 and rotated 180 degrees about a longitudinal axis.

Figure 9:
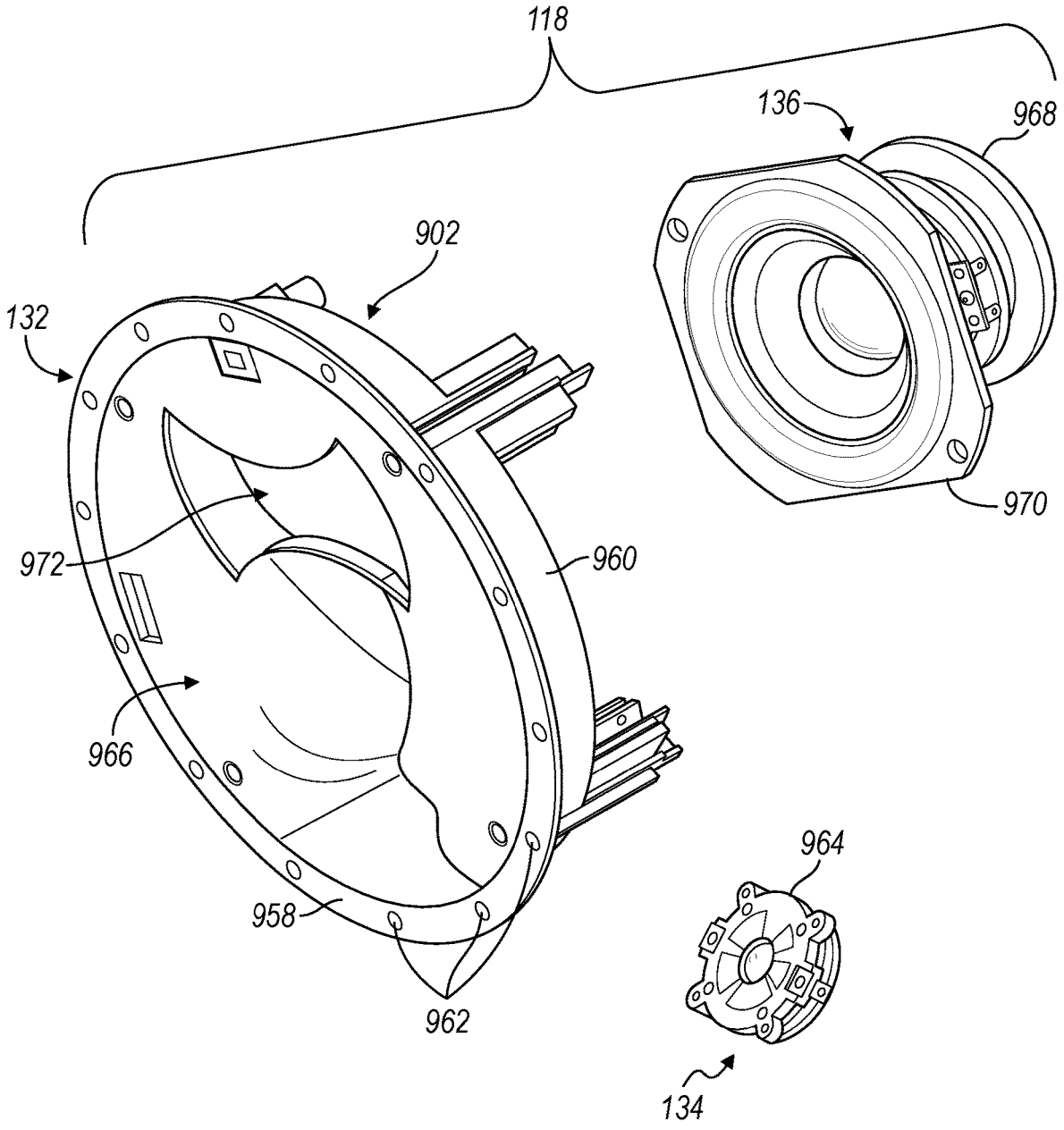
FIG. 9 is an exploded view of one of the top speaker systems of FIG. 1.

FIG. 9 is an exploded view of the top-left speaker system 118 including the housing 132, the first loudspeaker 134, and the second loudspeaker 136. The housing 132 provides for mounting the top-left speaker system 118 in an in-ceiling configuration. The housing 132 of the top-left speaker system 118 includes a faceplate 958 and a frame 960. The faceplate 958 is formed in a generally annular shape with a series of apertures 962 formed around an outer periphery to receive fasteners (not shown) to mount to a support, e.g., a ceiling. The frame 960 extends from the faceplate 958 to extend through the ceiling (shown in FIG. 11A) to provide an in-ceiling speaker system configuration. The frame 960 supports the first loudspeaker 134 and the second loudspeaker 136. The housing 902, including the faceplate 958 and the frame 960, may be integrally formed as a single component, which reduces weight and simplifies assembly.

The first loudspeaker 134 includes a first driver 964 and a horn 966. The first driver 964 receives an audio signal from the audio source 154 and/or home controller 156 (FIG. 1) and projects sound. The first driver 964 may be a compact high-frequency compression driver or tweeter that projects sound between 2 kHz and 20 kHz. The horn 966 guides the sound projected by the first driver 964 to form an asymmetric pattern. The horn 966 may be integrated into the housing 132 or attached to the housing 132.

The second loudspeaker 136 includes a second driver 968 and a diaphragm 970. The second driver 968 may be a compact low-frequency compression driver or woofer that projects sound between 50 Hz and 1 kHz. The diaphragm 970 attaches to the second driver 968 and to the housing 132 about an opening 972 formed through the horn 966.

Figure 10:
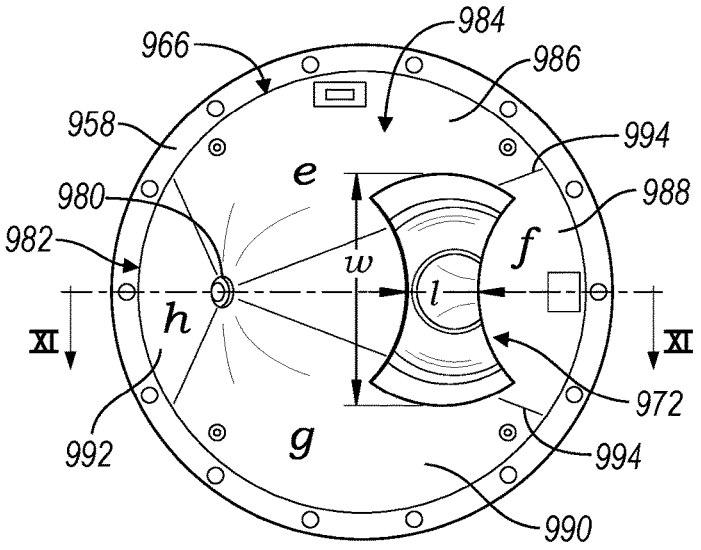
FIG. 10 is a bottom view of the top speaker system of FIG. 9.
Figure 11A:
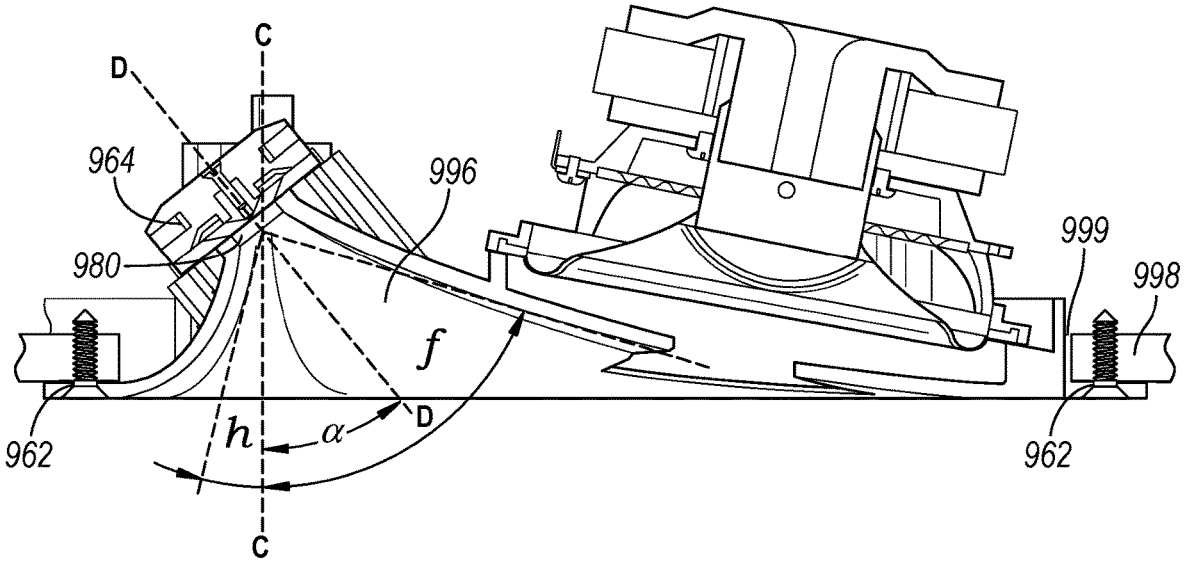
FIG. 11A is an enlarged section view of the top speaker system of FIG. 10, taken along section line XI-XI.

Referring to FIGS. 10 and 11A, the shape of the horn 966 provides an asymmetrical sound coverage pattern. The horn 966 includes a throat 980 and a mouth 982. The throat 980 is disposed adjacent to the first driver 964 to receive projected sound. The mouth 982 is arranged adjacent to the faceplate 958. The horn 966 also includes a waveguide 984 that extends from the throat 980 to the mouth 982. The waveguide 984 includes four segments: a first segment 986, a second segment 988, a third segment 990, and a fourth segment 992. The four segments are angularly spaced apart from each other about a vertical Axis C that extends through the throat 980 and normal to the faceplate 958. Adjacent segments are coupled to each other by joints 994 that extend between the throat 980 and the mouth 982. The waveguide 984 may also be formed as a single unitary structure with the joints 994 extending between adjacent segments.

With reference to FIG. 11A, the first driver 964 is mounted to the frame 960 at an acute angle relative to the faceplate 958 to project sound about an Axis D that extends at an offset angle relative to Axis C. The waveguide 984 is formed in a generally frusto-pyramidal shape and defines a cavity 996 that extends along Axis D. The four segments 986, 988, 990, 992 flare outward from the throat 980 to the mouth 982. For example, the cross-sectional area of the waveguide 984 may expand exponentially. In other examples, the cross-sectional area of the waveguide 984 may remain substantially constant, contract, or any combination thereof.

The shape of the first segment 986 provides a coverage angle (e) in a horizontal plane relative to Axis C (not shown). The shape of the second segment 988 provides a coverage angle (f) in a longitudinal plane relative to Axis C. The shape of the third segment 990 provides a coverage angle (g) in a horizontal plane relative to Axis C (not shown). The shape of the fourth segment 992 provides a coverage angle (h) in a longitudinal plane relative to Axis C. The coverage angle is evaluated as a function of frequency and corresponds to the angle at which the intensity of sound, or sound pressure level (SPL), is half of the SPL on Axis C.

The second segment 988 and the fourth segment 992 are formed in different shapes to provide different coverage angles (f) and (h). Coverage angle (f) may be between 0-80 degrees and coverage angle (h) may be between 0-60 degrees. In one or more embodiments, the second segment 988 provides a coverage angle (f) of 80 degrees; and the fourth segment 992 provides a coverage angle (h) of 60 degrees. The first segment 986 and the third segment 990 may be formed in the same shape to provide the same coverage angle. Coverage angles (e) and (g) may be between 0-90 degrees. In one or more embodiments, angle (e) and angle (g) are both 80 degrees.

The speaker system 118 may be mounted within a ceiling 998. The apertures 962 of the faceplate 958 receive fasteners to mount the housing 132 to the ceiling 998. The frame 960 extends from the faceplate 958 to extend through an opening 999 in the ceiling 998.

Figure 11B:
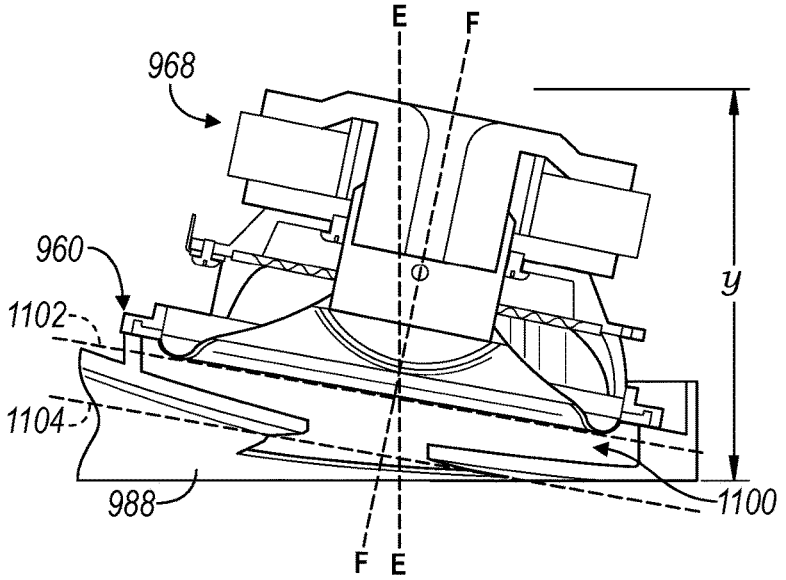
FIG. 11B is an enlarged partial section view of the top speaker system of FIG. 10, taken along section line XI-XI, illustrating a second loudspeaker.

With reference to FIG. 11B, the second driver 968 is mounted to the frame 960 at an acute angle relative to the faceplate 958 to project sound about an Axis F that extends at an offset angle relative to Axis E. The housing 902 defines a cavity 1100 that extends along Axis F. The second driver 968 is mounted to the frame 960 on a plane 1102 that is arranged generally parallel with a plane 1104 that extends along the second segment 988. This parallel arrangement minimizes the size of the cavity 1100 and sound reflections. The speaker system 118 has a compact design, e.g., with a depth (Y) that is less than 304.8 mm (12.0 inches), so that it fits within a standard ceiling 998.

With reference to FIGS. 9-11B, the opening 972 is sized to optimize sound projecting from the first loudspeaker 134 and the second loudspeaker 136. The opening 972 is formed in a bow-tie shape with a width (W) that extends through the second segment 988 and partially through the first segment 986 and the third segment 990. The opening 972 includes a length (L) that is less than the width (W). The opening 972 is formed to maximize the surface area of the second segment 988 to minimize any sound projecting from the first loudspeaker 134 from entering the cavity 1100 of the second loudspeaker 136 and minimize sound pressure level (SPL) losses and directivity losses from both the first loudspeaker 134 and the second loudspeaker 136.

Figure 12:
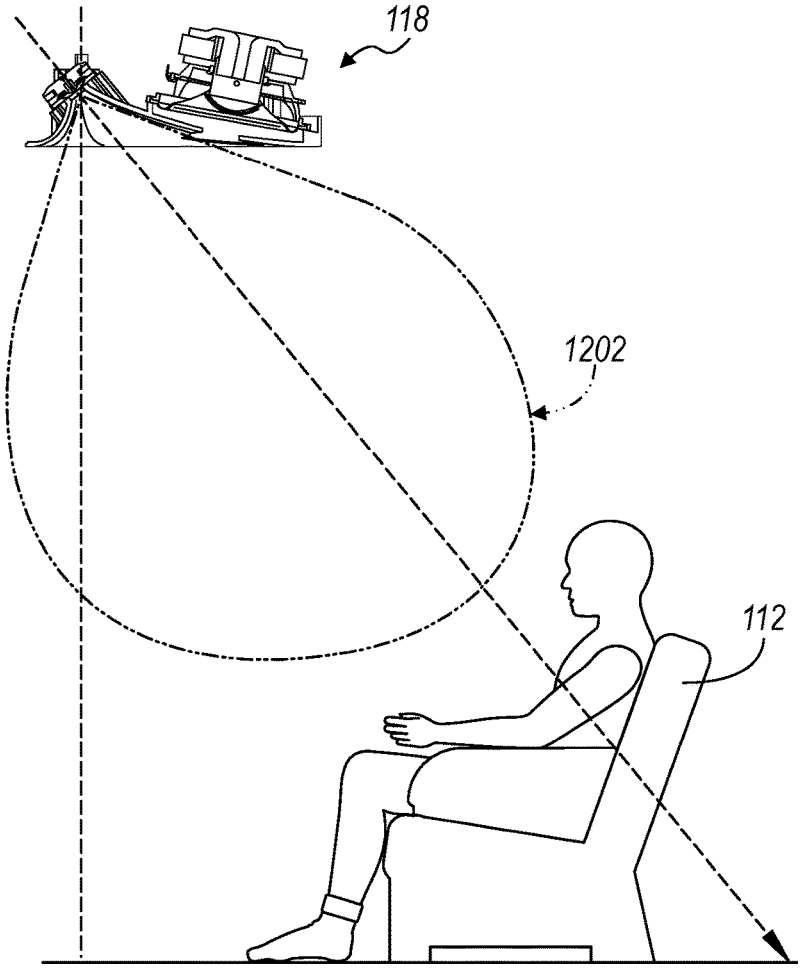
FIG. 12 is side view of the home entertainment system of FIG. 1, illustrating the top speaker system providing an asymmetrical sound coverage pattern within the listening environment.

Referring to FIG. 12, the top-left speaker system 118 and the top-right speaker system 120 (shown in FIG. 1) provide asymmetrical coverage patterns 1202 in a longitudinal plane to project sound toward the target listening area 112. The top-left speaker system 118 may be identical to the top-right speaker system 120.

While exemplary embodiments are described above, it is not intended that these embodiments describe all possible forms. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. A speaker system comprising:

a housing adapted to mount to a support;

a driver supported by the housing and arranged to project sound about a first axis extending at an offset angle relative to a longitudinal axis from the housing; and a waveguide supported by the housing and extending from the driver to define a cavity extending along the first axis, the waveguide comprising:

a first segment formed at a first angle relative to the longitudinal axis, and a second segment formed at a second angle relative to the longitudinal axis, wherein the second segment is arranged opposite the first segment and the second angle is greater than the first angle to collectively provide an asymmetrical sound pattern in a first plane, a third segment, and a fourth segment arranged opposite the third segment, each of the third segment and the fourth segment formed at a third angle relative to the longitudinal axis to collectively provide a symmetrical sound pattern in a second plane that is arranged orthogonal to the first plane.

2. The speaker system of claim 1 further comprising a horn, the horn comprising:

a throat disposed adjacent to the driver to receive projected sound;

a mouth coupled to the housing; and the waveguide, wherein the waveguide extends between the throat and the mouth.

3. The speaker system of claim 1, wherein driver comprises a first driver, and the housing comprises a faceplate and a frame extending from the faceplate to be received in a hole formed in the support, the speaker system further comprising a second driver supported by the frame to project sound about a second axis.

4. The speaker system of claim 3, wherein the first driver comprises a high-frequency driver and the second driver comprises a low-frequency driver.

5. The speaker system of claim 3, wherein the second driver is mounted generally parallel to the faceplate such that the second axis extends parallel to the longitudinal axis.

6. The speaker system of claim 3, wherein the second driver is mounted at an acute angle relative to the faceplate.

7. The speaker system of claim 3, wherein the second driver is mounted generally parallel to the second segment of the waveguide to minimize a depth of the frame.

8. The speaker system of claim 7, wherein the second driver is axially aligned with an opening formed through the second segment of the waveguide.

9. The speaker system of claim 8, wherein the opening is formed with a length that is less than a width.

10. The speaker system of claim 1, wherein the housing and the waveguide are integrally formed.

11. A home entertainment system comprising:

first and second speaker systems, each according to claim 1, to mount to a front-right portion of a room and to a front-left portion of the room.

12. The home entertainment system of claim 11 further comprising:

third and fourth speaker systems, each according to claim 1, to mount to a top-right portion of the room and to a top-left portion of the room.

13. A speaker system comprising:

a faceplate adapted to mount to a wall or a ceiling;

a frame extending from the faceplate to be received in the wall or the ceiling;

a first driver, wherein the first driver is supported by the frame to project sound about a first axis;

a horn comprising:

a throat disposed adjacent to the first driver to receive projected sound, the throat arranged about the first axis extending from the first driver at an offset angle relative to a longitudinal axis extending normal to the faceplate;

a mouth coupled to the faceplate; and a waveguide extending from the throat to the mouth to define a cavity extending along the first axis, the waveguide comprising: a first segment formed at a first angle relative to the longitudinal axis, and a second segment formed at a second angle relative to the longitudinal axis, wherein the second segment is arranged opposite the first segment and the second angle is greater than the first angle to collectively provide an asymmetrical sound pattern in a first plane; and a second driver supported by the frame to project sound about a second axis, wherein the second driver is mounted generally parallel to the second segment of the waveguide to minimize a depth of the frame.

14. The speaker system of claim 13, wherein the second driver is axially aligned with an opening formed through the second segment of the waveguide, and wherein the opening is formed with a length that is less than a width.

15. A speaker system comprising:

a housing with a faceplate, and a frame extending from the faceplate;

a first driver supported by the frame and arranged to project sound about a first axis extending at an offset angle relative to a longitudinal axis extending normal to the faceplate;

a second driver supported by the frame to project sound about a second axis; and a horn comprising:

a throat disposed adjacent to the first driver to receive projected sound, a mouth coupled to the faceplate, and a waveguide extending from the throat to the mouth to define a cavity extending along the first axis, the waveguide comprising: a first segment formed at a first angle relative to the longitudinal axis, and a second segment formed at a second angle relative to the longitudinal axis, wherein the second segment is arranged opposite the first segment and the second angle is greater than the first angle to collectively provide an asymmetrical sound pattern in a first plane;

wherein the second driver is mounted generally parallel to the second segment of the waveguide to minimize a depth of the frame.

16. The speaker system of claim 15, wherein the second driver is axially aligned with an opening formed through the second segment of the waveguide, and wherein the opening is formed with a length that is less than a width.

17. The speaker system of claim 6, wherein the first driver is mounted at an acute angle relative to the faceplate such that the first axis extends at an offset angle relative to the longitudinal axis.

18. The speaker system of claim 7, wherein the second driver is spaced apart from the second segment to form a cavity, and wherein the second driver is mounted generally parallel to the second segment of the waveguide to minimize a size of the cavity and sound reflections within the cavity.

19. The speaker system of claim 9, wherein the second segment extends over a portion of the cavity about the opening to minimize the sound projecting from the first driver from entering the cavity.

20. The speaker system of claim 9, wherein the opening is formed in a bow-tie shape.

* * * * *